United States Patent [19]

Szabo

[11] Patent Number: 4,862,618

[45] Date of Patent: Sep. 5, 1989

[54] HAND-GUN CONVERSION KIT

[76] Inventor: Attila Szabo, No. 3 Concord Pl.-Apt. 2701, Don Mills, Canada, M3C 3K7

[21] Appl. No.: 262,761

[22] Filed: Oct. 21, 1988

[51] Int. Cl.[4] ..... F41C 25/02; F41C 15/06

[52] U.S. Cl. ..... 42/7; 42/50

[58] Field of Search ..... 42/7, 71.02, 50, 69.03

[56] References Cited

U.S. PATENT DOCUMENTS

| | | | |
|---|---|---|---|
| 283,122 | 8/1883 | Lewis | 42/50 |
| 984,519 | 2/1911 | Browning | 42/7 |
| 1,168,024 | 1/1916 | Nelson | 42/7 |
| 1,234,961 | 7/1917 | Tansley | 42/7 |
| 3,110,223 | 11/1963 | Schlappich | 42/7 |
| 4,589,218 | 5/1986 | Teppa | 42/50 |
| 4,747,224 | 5/1988 | Smith | 42/7 |

FOREIGN PATENT DOCUMENTS

| | | | |
|---|---|---|---|
| 2137321 | 10/1984 | United Kingdom | 42/7 |

*Primary Examiner*—David H. Brown

[57] ABSTRACT

This kit is to convert a semi-automatic hand-gun, such as the Colt model 1911A1, into a hand-gun of increased round capacity from the original seven-round to thirteen round by replacing the conventional frame, magazine, magazine catch, grip covers, and trigger assembly by new similar parts, while still retaining the remaining parts of the hand-gun, including the slide, barrel, breech block, firing pin and hammer mechanism, manual safety catch and take-down latch.

13 Claims, 3 Drawing Sheets

Fig. 6
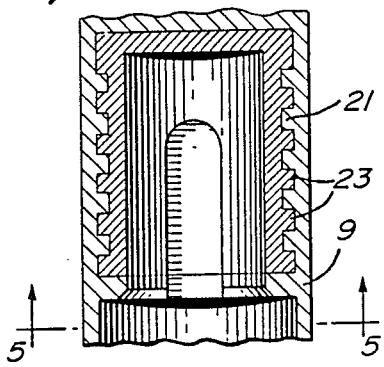
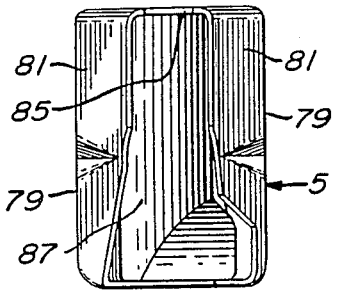
Fig. 11
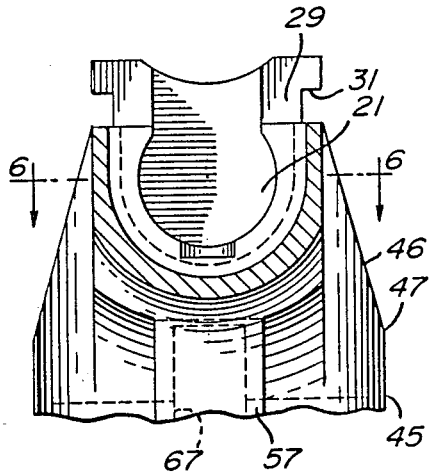
Fig. 5
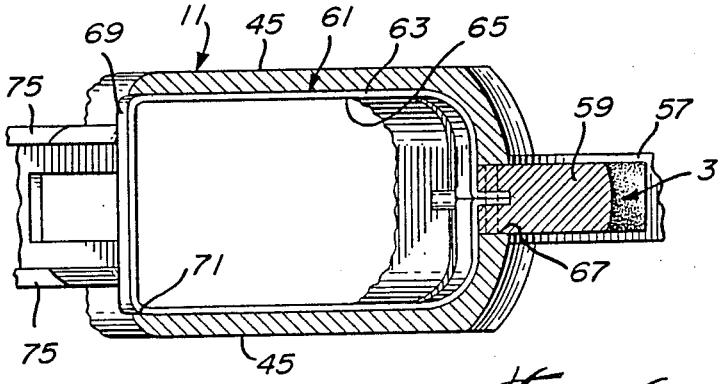
Fig. 4

HAND-GUN CONVERSION KIT

FIELD OF THE INVENTION

This invention relates to hand-guns and, more specifically, to a kit for converting an existing hand-gun to one of increased round capacity.

BACKGROUND OF THE INVENTION

The semi-automatic hand-gun known as the Colt government model 1911A1, which has a caliber of 45 mm, has a seven-round capacity. This hand-gun is widely used in spite of its limited round capacity. In such a conventional hand-gun, the rounds in the magazine are in a straight line configuration. A proposal has been put to increase the length of the magazine and, consequently, of the handle to increase the round capacity; but this proved to be too cumbersome.

OBJECTS OF THE INVENTION

It is the general object of the present invention to convert a semi-automatic hand-gun of a given round capacity to a much-increased round capacity while replacing only the frame, the trigger assembly, the magazine, the magazine catch, and the grip covers and using the other conventional parts of the original hand-gun.

Another object of the present invention is to provide a conversion kit of the character described, in which the grip of the converted hand-gun has the same length, albeit a greater width than the grip of the original gun and yet the guide rails for the slide conserve their full uninterrupted length.

Another object of the present invention is to provide a conversion kit of the character described, wherein the hand-gun has about 85% increase in magazine capacity by just increasing the width of the grip.

Another object of the present invention is to provide a converted hand-gun which handles still better than the original gun, because of the increased width of its hand-grip.

Another object of the invention is to provide a converted hand-gun of increased round capacity which, when full is about of the same weight as the full original hand-gun.

SUMMARY OF THE INVENTION

The conversion kit of the invention comprises a frame, a magazine, a magazine catch, a trigger assembly and a pair of grip covers to replace the like parts of the conventional hand-gun. The frame is in one cast piece, preferably made of a light-weight aluminum alloy, and includes an elongated top part and a grip downwardly depending at an angle from an intermediate portion of said top part. The top part has longitudinal uninterrupted grooves serving as guides for the conventional slide of the hand-gun. The frame has a through-bore defining a magazine chamber extending through the handle part and the top part and opening at the bottom end and at the top part. Said through-bore is defined by front and back transverse faces, which are substantially flat and parallel throughout their length and by opposite side faces which are substantially parallel to the long axis of the top part, and each defining a lower side face portion; an intermediate side portion and an upper side face portion. The lower side face portions are straight and parallel to each other and their transverse spacing is such as to accommodate a magazine with rounds in staggered configuration. The intermediate face portions are converging towards each other and the upper face portions are spaced from each other to accommodate the upper part of the magazine in which the rounds are in a single-line configuration.

The top part has a front portion, preferably of semi-circular cross-section, forming an upwardly-opening trough for receiving the shock absorber re-coil assembly of the breech block and barrel. The frame is preferably made of an aluminum alloy for light weight, but the rear portion of the trough is preferably provided with an externally-ribbed insert, of steel or the like, embedded in the alloy to resist the re-coil forces produced during firing. The top part preferably has a rear extension protruding from the grip to which the conventional hammer mechanism is pivoted.

The magazine has a shape to fit said through-bore. The trigger assembly consists of a finger engaging part which is slidably mounted in a front opening made in the front of said grip just below said top part, and of a loop fixed to said finger-engaging part, surrounding said magazine and preferably slidable within grooves made in the internal side faces of said through-bore. In the rear limit position of the trigger assembly, the back of the loop protrudes from a rear opening made in the back transverse face of the grip to actuate the hammer mechanism. The grip is preferably provided with rearwardly-extending, inwardly-recessed flanges, which each has a cut-out to accommodate the rear portion of the loop when moving rearwardly to its rear limit position. Grip covers are provided, each preferably having a rear extension to cover these cut-outs and the rear portion of the loop. The magazine is further preferably provided along its converging intermediate face portions with longitudinally-extending ribs for guiding the rounds from their staggered to their single line configuration.

BRIEF DESCRIPTION OF THE DRAWINGS

FIG. 4 is a plan section, taken along line 4—4 of FIG. 3 and showing the trigger assembly;

FIG. 5 is a cross-section, taken along line 5—5 of FIG. 3 and along line 5—5 of FIG. 6;

FIG. 6 is a plan section, taken along line 6—6 of FIG. 5;

Figure 8:
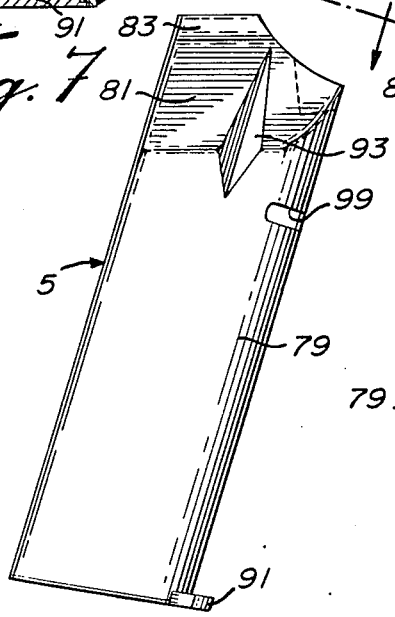
Figure 9:
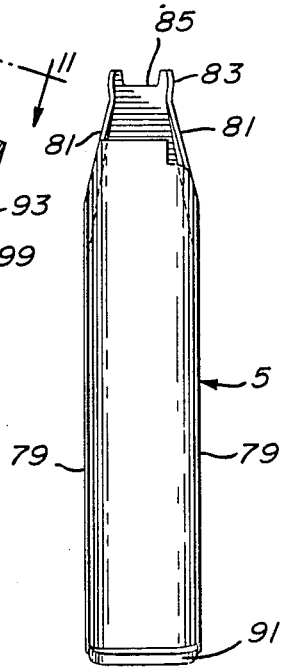
Figure 10:
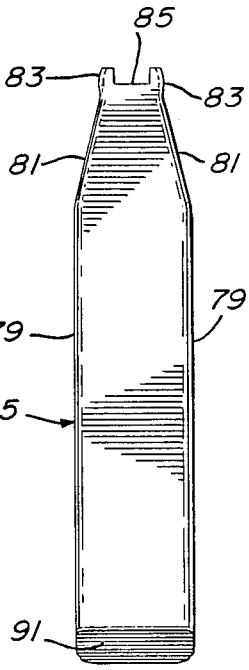

FIG. *7a* is a partial cross-section of the grip, on an enlarged scale;

FIG. 8, 9, and 10 are a side elevation, a front elevation and a rear elevation respectively of the magazine; and FIG. 11 is a top end view of the magazine, taken along line 11—11 of FIG. 8.

DETAILED DESCRIPTION OF THE PREFERRED EMBODIMENT

The conversion kit of the invention comprises a frame 1, a trigger assembly 3, a magazine 5 and grip covers 7. Also, screws and a magazine catch are provided. The frame 1 is preferably made of an aluminum alloy for light weight by investment casting. Frame 1 could also be made by electro-chemical machining, but this is more expensive. By using an aluminum alloy, the entire modified hand-gun, loaded with thirteen rounds, weighs about the same as an all-steel non-converted Colt type hand-gun loaded with seven rounds. The frame 1 is of a one-piece construction, comprising an elongated top part 9, from an intermediate portion of which downwardly projects a grip 11 at an angle thereto. Grip 11 has the same downward, rearward inclination as the conventional Colt hand-gun.

Top part 9 defines a front portion 13 and a rear portion 15. These front and rear portions 13 and 15 have external side faces 17, which are co-planar throughout the length of the top part and which are parallel to each other and at the same distance apart to the corresponding side faces of the conventional frame of the handgun to be replaced by frame 1. The front portion 13 has a cross-sectionally generally semi-circular shape to define an upwardly-extending trough for receiving the conventional re-coil spring and guide buffer assembly 19 of the Colt hand-gun. The rear end of said trough is provided with a steel insert 21 (see FIGS. 3 and 6), having external ribs 23 embedded within the aluminum alloy of the frame to better resist the thrust of the re-coil exerted by the re-coil assembly 19 during firing. The steel insert 21 has the same internal shape as the corresponding portion of the conventional frame, which frame it replaces. If the head of the spring guide is made of plastic, insert 21 can be dispensed with.

The rear portion 15 has a top face 25 which is higher than the top longitudinal edges 27 of the front portion 13. A step 29 is formed at the junction of edges 27 with top face 25. The side faces 17 are each provided with a groove 31 extending longitudinally of the top part 9 and adjacent to and parallel to the top face 25.

The grooves 31 open forwardly at the step 29 and also rearwardly of the rear portion 15. These grooves 31 are uninterrupted from end to end and serve as a guide for the conventional slide A of the hand-gun and which encloses the barrel and the breech block. During recoil, the slide stops on step 29 and the barrel stops on the bottom of insert 21 or on the equivalent upright wall formed by frame 1.

The top part 9 has a pair of spaced, rear extensions 33 for housing the conventional hammer C, which is pivoted between the rear extensions 33 at holes 35 made therein. One extension 33 has also a hole 37 to carry the conventional manual safety catch.

Grip 11 has a through-bore 39 forming a magazine chamber. This through-bore 39 opens at the top face 25 of the top part 9, to form a top opening 41, of restricted width. Through-bore 39 also opens at the bottom end of the grip 11 to form a bottom opening 43 of a width wider than the top opening 41. The grip 11 is wider than the top part 9, having external side faces 45, which laterally protrude from the side faces 17 of the top part 9.

The external side faces 45 are parallel to each other and are flat and each starting from a zone 47 just below the top part 9, are inclined, converge towards and merge with the side faces 17 of the top part 9, as indicated at 46. Similarly, the internal opposite side faces 49 of the through-bore 39, that is those side faces which are parallel to the longitudinal axis of the top part 9, are each formed of a bottom face portion 51, an intermediate face portion 53 and a top face portion 55. The bottom side face portions 51 are flat and parallel to each other and extend up to about the zone 47. The intermediate face portions 53 are upwardly converging, while the top face portions 55 are parallel to each other and extend through a small height and are spaced apart by a width corresponding to the restricted width top opening 41. The distance between the bottom side face portions 51 corresponds to the width of bottom opening 43.

Since intermediate face portions 53 of through-bore 39 are upwardly converging, converging walls of substantially uniform thickness are obtained and, therefore, guide grooves 31 which are completely uninterrupted. It follows that the slidable connection between slide A and frame 1 is not weakened. This is an essential characteristic of the frame 1.

A straight rib 54, of partly circular cross-section, is integrally cast with frame 1 and protrudes from one external side face 17 of top part 9 just below groove 31 and parallel thereto. Rib 54 has a through-bore to form a tube which is adapted to receive an intermediate compression spring outwardly biasing a front and a rear plunger serving respectively as a detent for the conventional take-down latch mounted in hole 56 of frame 1 and for the conventional manual safety catch mounted in hole 37, respectively. Since rib 54 is integral with frame 1, it is less expensive than, and is not liable to become loose compared to the equivalent conventional tube which it replaces. This conventional tube is a separate part secured by screws to the conventional frame.

A trigger guard 57 is integrally formed with frame 1 below top part 9 and forwardly of the grip 11.

Figure 3:
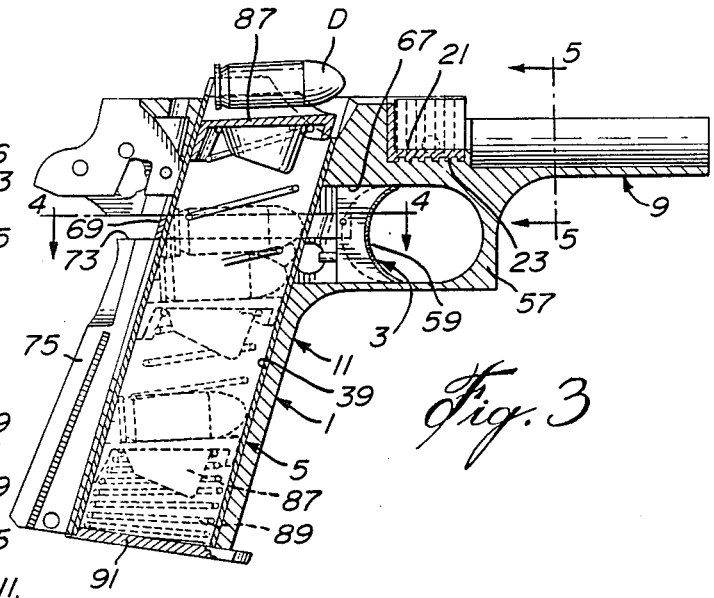
FIG. 3 is a longitudinal section of the frame of FIG. 2 and showing the magazine in position.

The trigger assembly 3 comprises a finger-engaging part 59 to which is secured a loop 61. Loop 61 is shaped in the same manner as a conventional loop, except that it is wider and its side legs 63 are slidable within grooves 65 made in the internal side faces of the through-bore 39, just below the top part 9, Thus, the legs 63 do not interfere with the magazine 5 inserted within the magazine chamber or through-bore 39. The finger-engaging part 59 of the trigger assembly is slidable within a front opening 67 of the grip 11 for movement between a front limit position, as shown in FIG. 3, in which the rear transverse leg 69 of the loop 61 abuts against the rear of the magazine 5 and a rear limit position in which the rear leg 69 of the loop 61 engages and operates the hammer and the firing pin of the handgun in conventional manner. The rear transverse leg 69 of the loop 61 moves out of a rear opening 71 of the grip and moves through cut-outs 73, each made in one of the pair of transverse flanges 75 which extend rearwardly from grip 11 and are substantially co-extensive therewith, these flanges 75 being inwardly recessed with respect to the external faces 45 of grip 11 and being substantially co-planar with the external side faces 17 of the top part 9, so as to be at the standard distance apart.

The conventional cocking spring mechanism of the hammer is housed between these flanges 75, which are closed at their rear end by the usual cover of the conventional hand-gun.

Grip covers 7 are preferably made of plastic and are fixed by means of screws 8 to the external side faces 45 of the grip 11, so as to flatly abut and cover said external side faces, including the inclined side face portions 46 above zone 47. The grip covers 7 are characterized by the fact that they have a rear extension 77 integrally formed therewith, which cover and hide the rear portion of the loop 61 and the cut-outs 73.

An advantage of the present invention is the fact that frame 1 is integrally cast with circular bosses which protrude from both external side faces 45 of grip 11 and which are tapped to receive screws 8 which secure covers 7 to grip 11. Bosses 12 fit within cavities made in the covers 7. This arrangement is simpler, less expensive and longer-lasting than the conventional method of securing separate inwardly-threaded bushings in holes made in the side walls of the grip, these bushings tending to become loose with use of the hand-gun.

Magazine 5 is shaped to exactly fit the magazine chamber or through-bore 39. It includes a pair of flat spaced, parallel lower side wall portions 79, which extend through the major portion of the height of the magazine 5, followed by upwardly-converging intermediate side wall portions 81 which in turn are followed by top wall portions 83, which are generally parallel to each other and are of restricted height. Wall portions 79, 81, and 83 fit the corresponding internal side faces 51, 53, and 55 of through-bore 39. Magazine 5 has a top opening 85, shaped as the top opening of a conventional magazine. The top wall portions 83 are spaced by such a distance as to slidably fit a single round D. The distance between the lower wall portions 79 is sufficient to permit a staggered configuration of the rounds D.

A round-engaging follower 87 is located within the magazine 5, this follower having an inclined top face of conventional construction but being characterized by the fact that it is narrower than the distance between the lower wall portions 79 and being of a width such as to stop when reaching an upper limit position by engagement with the lower edge of the top wall portions 83.

Follower 87 is urged upwardly by a compression coil spring 89 which extends between the follower and a bottom cover 91, closing the bottom opening of the magazine 5. This bottom cover 91 is in itself of conventional construction. In order to accommodate as great a number of rounds as possible, the coil spring 89 is preferably shaped, so as to have lower coils of substantially equal size, and upper coils of progressively-decreasing size, so as to nest within each other and within the topmost lower coil.

Figure 1:
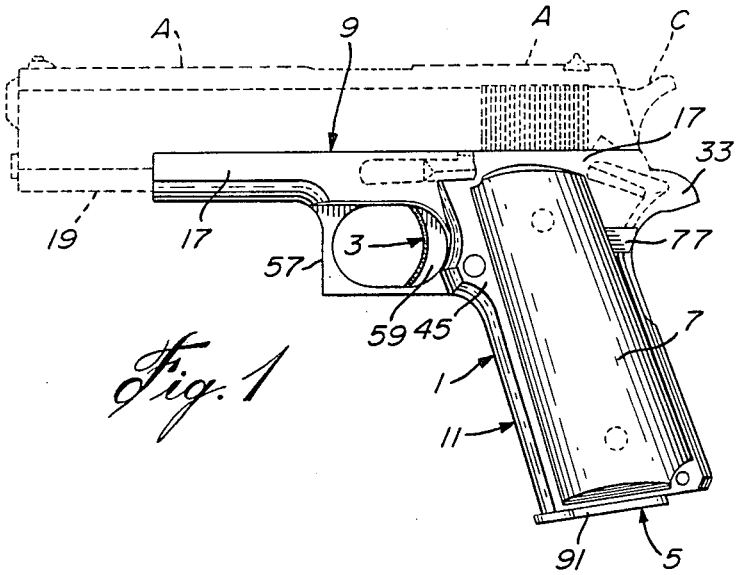
FIG. 1 is a side elevation of the frame, trigger and handle cover of the conversion kit of the invention, shown in full lines, the conventional parts of the hand-gun being shown in dotted line.
Figure 2:
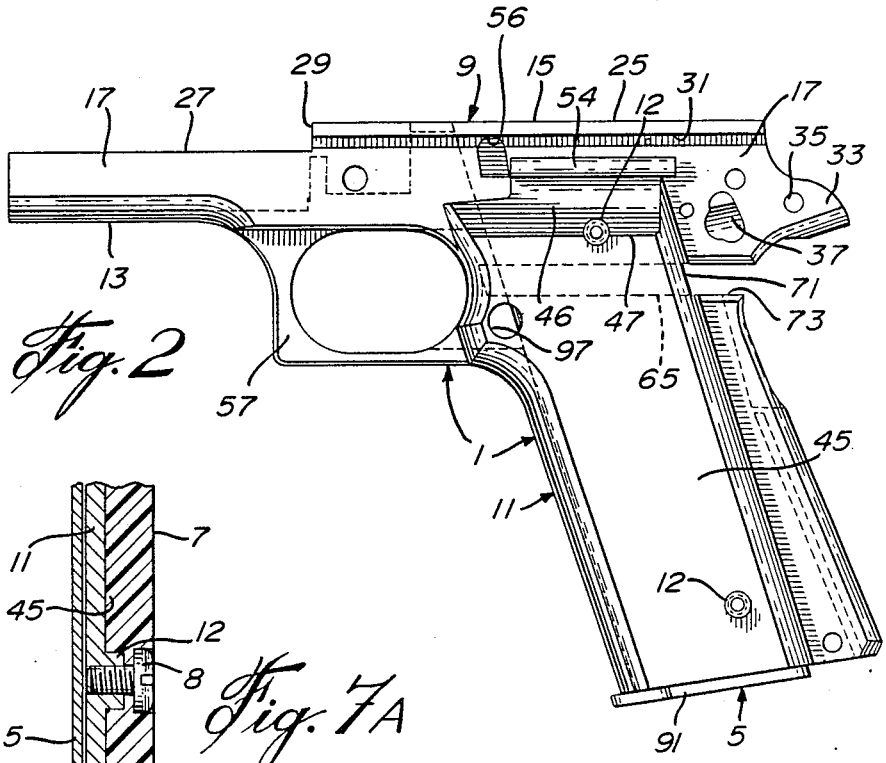
FIG. 2 is a side elevation of the frame of the conversion kit, the trigger assembly being removed, the bottom cover of the magazine being shown.
Figure 7A:
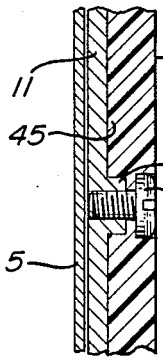
FIG. 7 is a cross-section, taken through the magazine and the grip.
Figure 7:
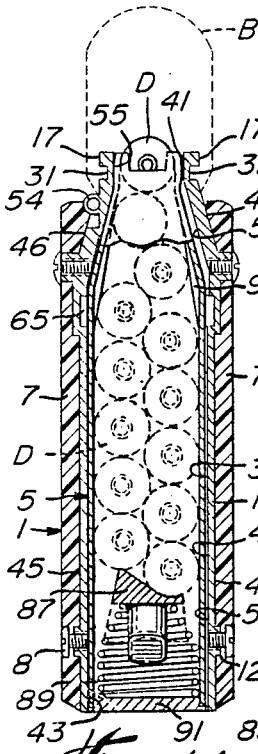

In order to facilitate and properly guide the rounds when passing from their staggered configuration to their single-line configuration, so as to issue one by one at the top of the magazine, the side walls of this magazine are provided with substantially diamond-shaped depressions 93 defining on the inside of the magazine, as shown in FIG. 7, longitudinally-extending central ribs 95 which engage and guide only the body of the rounds and not their rear rim. Thus, the rounds are kept properly aligned.

Frame 1 is provided with a conventional hole 97 to receive a magazine catch for engaging a slot 99 in the magazine wall to retain the magazine 5 in locked position within the magazine chamber. This magazine catch (not shown) is of conventional construction but longer to fit the wide grip 11. The frame 1 is also provided with various holes to fix the other standard parts of the hand-gun.

What I claim is:

1. A conversion kit to convert a semi-automatic hand-gun of a predetermined round capacity to a hand-gun of a higher round capacity, comprising: a frame made in one piece including an elongated top part having a constant width throughout its length and flat, parallel external side faces, each with an open-ended groove defining guides for the conventional slide of said hand-gun, and a grip downwardly depending at an angle from an intermediate portion of said top part and having a bottom end, said grip having a width greater than the width of said top part with external side faces merging with the external side faces of said top part below said grooves, said frame having a through-bore defining a magazine chamber extending through said grip and through said top part and forming a bottom opening through said bottom end and a top opening through said top part, said through-bore having opposite side faces substantially parallel to the long axis of said top part and defining lower side face portions which are straight and parallel to each other, starting from said bottom end to a zone just below said top part, followed by intermediate face portions which are converging and in turn followed by upper face portions which are substantially parallel to each other, said grooves being uninterrupted from end to end and adapted to slidably retain said slide for reciprocating movement of the latter.

2. A conversion kit as defined in claim 1, further including a magazine for carrying rounds in staggered configuration, said magazine having side walls, each formed of a lower wall portion, an intermediate wall portion and an upper wall portion, shaped to fit the respective side face portions of said through-bore when fully inserted into said chamber, said magazine defining a top opening for passage of a single round, said intermediate wall portions guiding the rounds from a staggered configuration between said lower wall portions to a single round configuration between said upper wall portions.

3. A conversion kit as defined in claim 2, wherein said grip has a front and a back opening communicating with said through-bore just below said top part, and further including a trigger assembly consisting of a finger-engaging part and of a loop fixed to said finger-engaging part, said trigger assembly slidable between a front limit position and a rear limit position, said finger-engaging part slidable through said front opening, said loop surrounding said magazine when inserted within said magazine chamber, and slidable within grooves made in said side faces of said through-bore and communicating with said back opening, said loop projecting through and rearwardly from said back opening in the rear limit position of said trigger assembly.

4. A conversion kit as defined in claim 3, wherein said grip has a pair of transversely-spaced flanges protruding rearwardly therefrom along the entire length thereof, said flanges transversely recessed from the outer side faces of said grip and substantially co-planar with the external side faces of said top part, each of said flanges having a cut-out in respective register with said grooves, whereby said loop enters said cut-outs in the rear limit position of said trigger assembly.

5. A conversion kit as defined in claim 4, further including a pair of grip covers fixed to the outer side faces of said grip and provided with a rearward extension in register with and covering said cut-outs.

6. A conversion kit as defined in claim 5, wherein bosses are integrally formed at the outer side faces of said grip and tapped to receive screws for fixing said covers to said grip.

7. A conversion kit as defined in claim 1, wherein said top part defines a front portion, of generally semi-circular cross-section, forming an upwardly-opening trough with top longitudinal edges and a rear portion defining a top face parallel to said top longitudinal edges and higher than the latter, a step being defined at the junction of said top longitudinal edges with said top face, each groove being adjacent to and parallel to said top face and opening at said step and at the rear end of said top part, said top opening of said through-bore located at said top part rear portion and of a width just sufficient for the discharge of a single round.

8. A conversion kit as claimed in claim 7, wherein said rear portion of said top part forms an extension protruding rearwardly from said grip and serving to pivotally mount the hammer of said hand-gun.

9. A conversion kit as claimed in claim 8, wherein said top part has an integrally-molded, elongated rib with a through-bore, said rib protruding from one external side face of said top part, parallel to and spaced below said top face of said rear portion.

10. A conversion kit as defined in claim 9, further including a magazine sized and shaped to fit within said through-bore and having substantially parallel lower and upper side wall portions and upwardly converging intermediate side wall portions, around follower in said magazine and of a width smaller than the distance between the two lower side wall portions and slightly larger than the distance between said two upper side wall portions, whereby the latter form a stop for said round followers; and further including a bottom cover and a compression spring within said magazine intermediate said bottom cover and said round follower and biasing the latter towards said stop.

11. A conversion kit as defined in claim 10, wherein said spring is a coil spring with lower coils, of substantially equal size, and upper coils, of progressively-decreasing size, so as to nest within each other and within the topmost lower coil when the spring is fully compressed.

12. A conversion kit as defined in claim 11, wherein each intermediate side wall portion is provided with a longitudinally-extending inwardly projecting rib for guiding the rounds from a staggered configuration to a single-round configuration.

13. A conversion kit as defined in claim 8, wherein said frame is made of a light-weight aluminium alloy and wherein a steel insert provided with external ribs and of semi-circular cross-section, is embedded within the rear end of said trough to resist the backward thrust exerted by the rear end of the recoil spring guide resting in said insert upon re-coil produced by firing of the hand-gun.

* * * * *